US005947045A

United States Patent [19]

Pietro

[11] Patent Number: 5,947,045

[45] Date of Patent: Sep. 7, 1999

[54] BALANCING SYSTEM FOR SAILING BOATS

[76] Inventor: Immordino Pietro, Strada Torino, 24 ter, 10024 Moncalieri, Italy

[21] Appl. No.: 08/999,549

[22] Filed: Dec. 19, 1997

Related U.S. Application Data

[63] Continuation of application No. PCT/IT96/00119, Jun. 13, 1996.

[30] Foreign Application Priority Data

Jun. 21, 1995 [IT] Italy ..... TO95A0516
Jun. 5, 1996 [IT] Italy ..... TO96A0497

[51] Int. Cl.[6] ..... B63B 35/00

[52] U.S. Cl. ..... 114/39.028; 114/91

[58] Field of Search ..... 114/39.1, 123, 114/90, 91, 89, 39.21, 39.26, 39.28

[56] References Cited

U.S. PATENT DOCUMENTS 3,985,106 10/1976 Ross .
4,094,263 6/1978 Marcil .
4,192,247 3/1980 Riordan .
4,570,562 2/1986 Dudouyt .
4,785,754 11/1988 Barberis .
4,878,447 11/1989 Thurston ..... 114/123

FOREIGN PATENT DOCUMENTS

A 2249542 4/1974 Germany .
WO A1
8700812 12/1987 WIPO .
WO 91/19641 12/1991 WIPO .

OTHER PUBLICATIONS

Derwent's Abstract, Nr L8053 B/51, week 7951, Abstract of SU, 655593 (Kirillov E V), Apr. 8, 1979.

*Primary Examiner*—Ed L. Swinehart
*Attorney, Agent, or Firm*—Darby & Darby

[57] ABSTRACT

This invention refers to single hull/multi-hull sailing boats. Two suitably shaped floats are laterally applied to the hull of single hull boats; they slide from top to bottom along suitable guides.

The lateral hulls of multi-hull boats also slide from top to bottom along suitable guides.

This device includes a sail mast moving in function of the wind lateral thrust on sails and the mast movement makes the lee float or hull to sink.

The lee float or hull sinking is used to oppose both the boat heeling and drift.

The invention application gets these advantages: improvement of the boat comfort and safety, increase of sails efficiency and optimization of hull hydrodynamic performances.

16 Claims, 10 Drawing Sheets

BALANCING SYSTEM FOR SAILING BOATS

This application is a continuation of PCT/IT96/00119 filed Jun. 13, 1996.

TECHNICAL FIELD

Single or multi-hull sailing boat equipped with at least one sail mast moving in respect to the hull, both lateral shrouds connected to ropes, blocks and winches to transmit the strength acting on shrouds to the boat heeling and drift balancing system.

The boat heeling balancing system of single hull boats comprises two suitable shaped and dimensioned floats placed on the two sides of the hull sliding on vertical or leaning guides.

The boat heeling balancing system of multi-hull boats comprises two suitable shaped and dimensioned hulls placed on the two sides of the boat sliding on vertical or leaning guides.

The lateral floats or lateral hulls are sunk into the water actuating pushing down rods, in such a way that, while sailing, the mast moves leeward following the wind pressure on the sails and the windward shroud force is transmitted to the rod which pushes the leeward float or hull down causing a sinking depending on the load acting on the windward shroud, without any crew intervention, thus the buoyancy of the leeward float or hull opposing the heeling moment caused by the wind pressure on the sails and, as a consequence, the boat heeling.

The sail mast moves laterally turning round a pin located in the foot or, alternatively, sliding transversely in respect to the hull, following the wind pressure on the sails.

PRIOR ART

In general, the sailing boats are subject to a heeling due to the wind pressure on sails. This heeling is partly or fully adjusted by the crew's windward movements.

U.S. Pat. Nos. 3,985,106 dated Oct. 12, 1976 and U.S. Pat. No. 4,094,263 dated Jun. 13, 1978 and the PCT/N091/00086 dated Jun. 17, 1991 (WO 91/19641 dated Dec. 26, 1991) describe some devices which adjust the heeling of a single hull boat through the automatic movement of the ballast induced by the mast movement.

U.S. Pat. No. 4,286,533 of the Sep. 1, 1981, describes a device where the adjustment of the heeling effect is achieved through the mast windward movement, implemented by the crew's intervention, and the movement of the crew itself.

In all above patents there is no adjusting sinking of the balancing system. This sinking, in the case of this patent device, is used to counteract the heeling and also the boat lateral drift.

The sinking of the means opposing the boat drift only when this is actually necessary, makes the same advantage than in a dinghy with centerboard, where the crew lowers the centerboard only while sailing point get this operation necessary.

DISCLOSURE OF THE INVENTION

This invention refers to single or multi-hull sailing boat, equipped with at least one sail mast moving in respect to the hull both lateral shrouds being connected to ropes, blocks and winches to transmit the strength acting on shrouds to the boat heeling and drift balancing system.

The boat heeling balancing system of single hull boat comprises two suitable shaped and dimensioned floats, placed on the two sides of the hull, sliding on vertical or leaning guides to be sunk into the water actuating pushing down rods, in such a way that, while sailing, the mast moves leeward following the wind pressure on the sails and the windward shroud force is transmitted to the rod which pushes the leeward float down causing a sinking depending on the load acting on the windward shroud, without any crew intervention, thus the buoyancy of the leeward float opposing the heeling moment caused by the wind pressure on the sails and, as a consequence, the boat heeling The lateral floats that counteract the heeling are designed in such a way that, when they are sunk, they oppose the boat drift depending on the wind pressure on the sails, thus acting as the centerboard of a dinghy The boat heeling balancing system of multi-hull boats comprises two suitable shaped and dimensioned hulls placed on the two sides of the boat sliding on vertical or leaning guides to be sunk into the water actuating pushing down rods, in such a way that, while sailing, the mast moves leeward following the wind pressure on the sails and the windward shroud force is transmitted to the rod which pushes the leeward hull down causing a sinking depending on the load acting on the windward shroud, without any crew intervention, thus the buoyancy of the leeward hull opposing the heeling moment caused by the wind pressure on the sails and, as a consequence, the boat heeling The lateral hulls that counteract the heeling are designed in such a way that, when they are sunk, they oppose the boat drift depending on the wind pressure on the sails, thus acting as the centerboard of a dinghy Devices transmitting the mast movement to boat heeling balancing system, that is ropes, blocks and winches, are designed in order to obtain boat sailing points allowing a good sails efficiency, a correct hydrodynamic trim and a safe boat sailing.

Sail mast moves laterally turning around a pin located in the foot or, alternatively, sliding transversely in respect to the hull, following the wind pressure on the sails.

Furthermore, the sail mast move partially independently by means opposing the heeling, if sudden gusts occur, to reduce the sail area exposed to the wind; in order to accomplish that target, we provided shrouds incorporating a pre-loaded spring device that makes the shroud to elongate when the sail wind pressure exceeds a prefixed value, thus making the mast to further turn, in such a way to reduce the exposed sails surface in order to avoid excessive or dangerous boat heeling.

Even though the following description and drawings refer to a single mast boat, this invention is applicable, as a specialized engineer will clearly understand, also to multi-mast boats.

SHORT DESCRIPTION OF DRAWINGS

This invention will be later explained, referring to the drawings shown on the enclosed FIGS. 1, 1*a*, 2, 3, 4, 5, 6, 7, 8, 9, 10 and 11. This invention is applicable both to single hull boats and to multi-hull boats. The above drawings show also three different actuation types, applicable both to single hull and multi-hull boats.

The graphic plotting of sails equipment and of sails itself are omitted in all mentioned figures for drawing simplicity and clearness of explanation. Furthermore, in the figures the stretching device that keeps the lee shroud stretched while sailing, is not shown.

Drawings of FIGS. 1, 2, 3 and 4 show the invention as applied to a single hull boat in the first actuation type; basically:

FIG. 1 is the cross section of a single hull boat in a rest state, with the invented device drawn, due to clearness reasons, referring to a single shroud;

FIG. 1*a* is a cross section showing the constructive details of the pre-stretched spring M2. In all other figures, this spring is shown schematically only;

FIG. 1*b* is a cross-section of a vertical float-rod guide, in a rest state, arranged for use with a single-hull boat;

FIG. 1*c* is a cross-section of a mast supported by a sliding shown in relation to a portion of single-hull boat;

FIG. 5 is a front view of a trimaran boat, under rest conditions, with the invented vented device drawn, due to clearness reasons, referring to a single shroud;

FIGS. 6, 7 and 8 are the front views of the boat shown at FIG. 5, with the invention device applied to both shrouds, under rest conditions, normal sailing point and gust conditions, respectively.

FIG. 9 is the front view of the boat under normal sailing point, with the applied invention device, due to clearness reasons, referring to a single shroud;

FIG. 10 is the front view of the boat, under the same sailing conditions, with the device applied to both shrouds.

Figure 11:
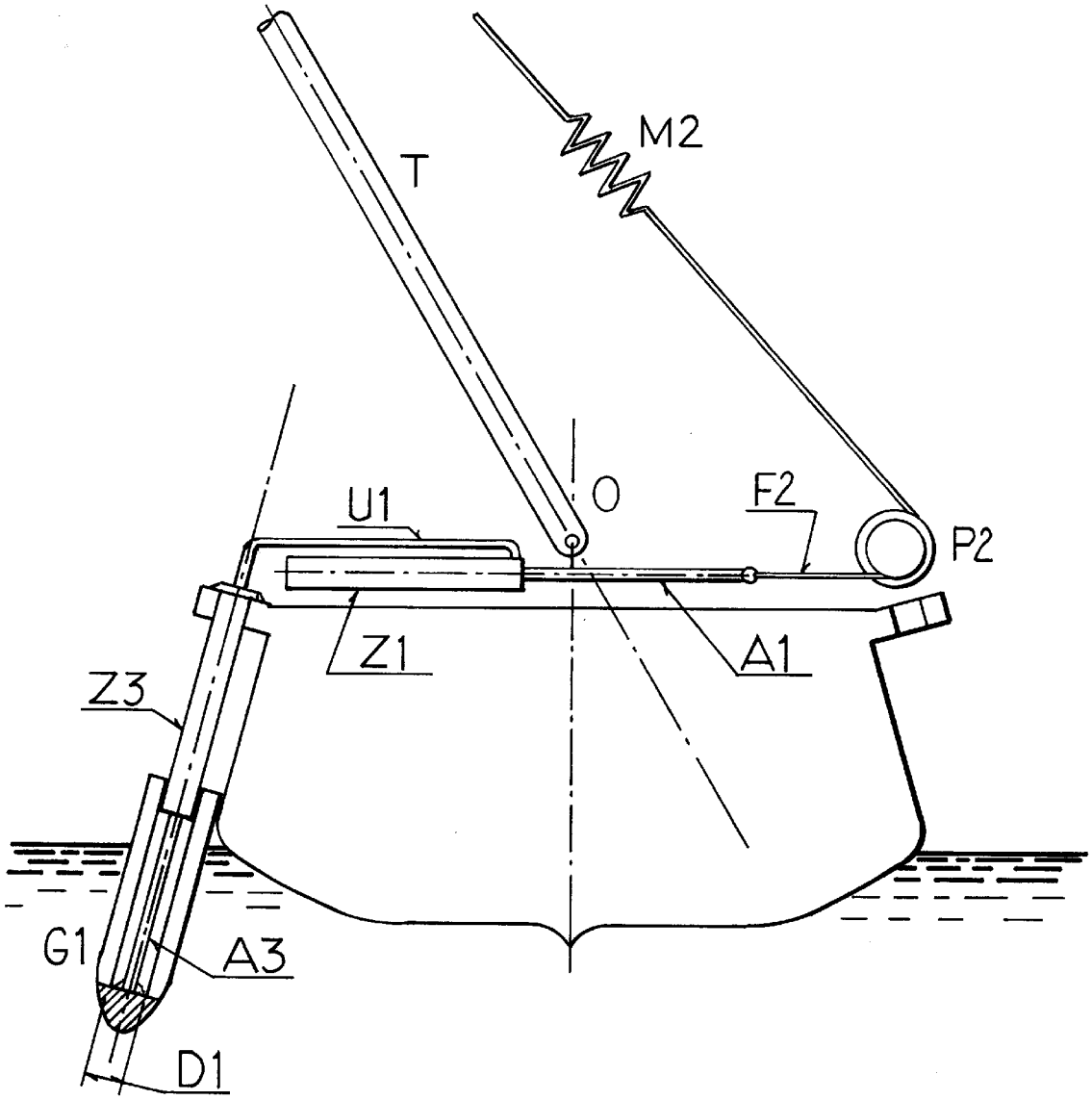

Instead, FIG. 11 shows the invention applied to a single hull boat in a third actuation type, consisting in transmitting the motion of the mast to the lee float through system constituted by hydraulic cylinders and pipelines, instead of ropes, blocks and winches, and precisely:

FIG. 11 is the cross section of the boat under normal sailing point, with the invented device drawn, due to clearness reasons, referring to a single shroud.

The three actuation types of the invention shown on the above drawings are, as it can clearly result to a specialized engineer, all applicable both to single hull boats and to multi-hull boats, even if only for the first of these types the device was drawn referring to both species of boats.

MODALITIES OF APPLYING THE INVENTION

1—First Type of Actuation

1a—Invention Applied to a Single Hull Boat

FIGS. 1, 2, 3 and 4 graphically describe the invention applied to a single hull boat.

Figures 1, 1A:
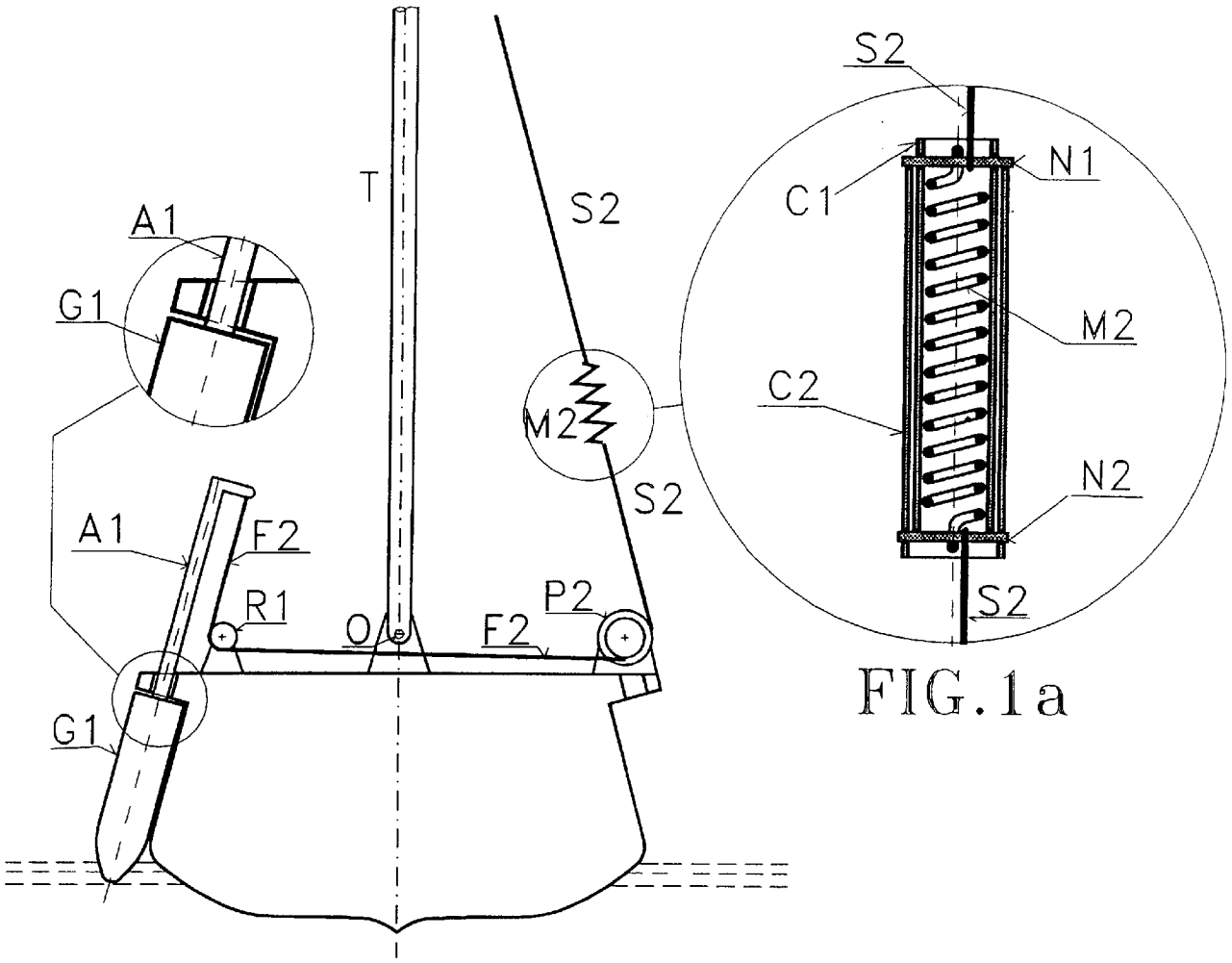
Figure 1B:
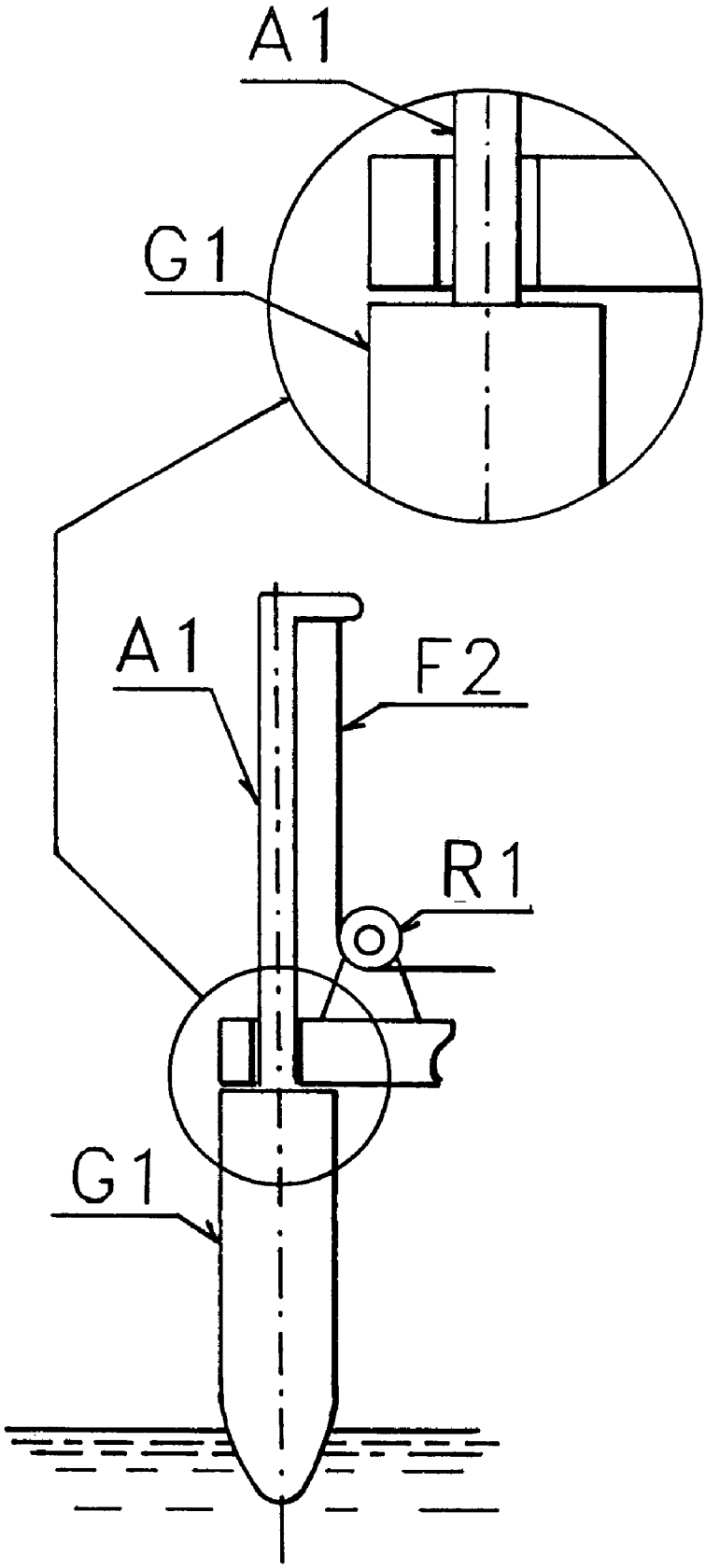
Figure 1C:
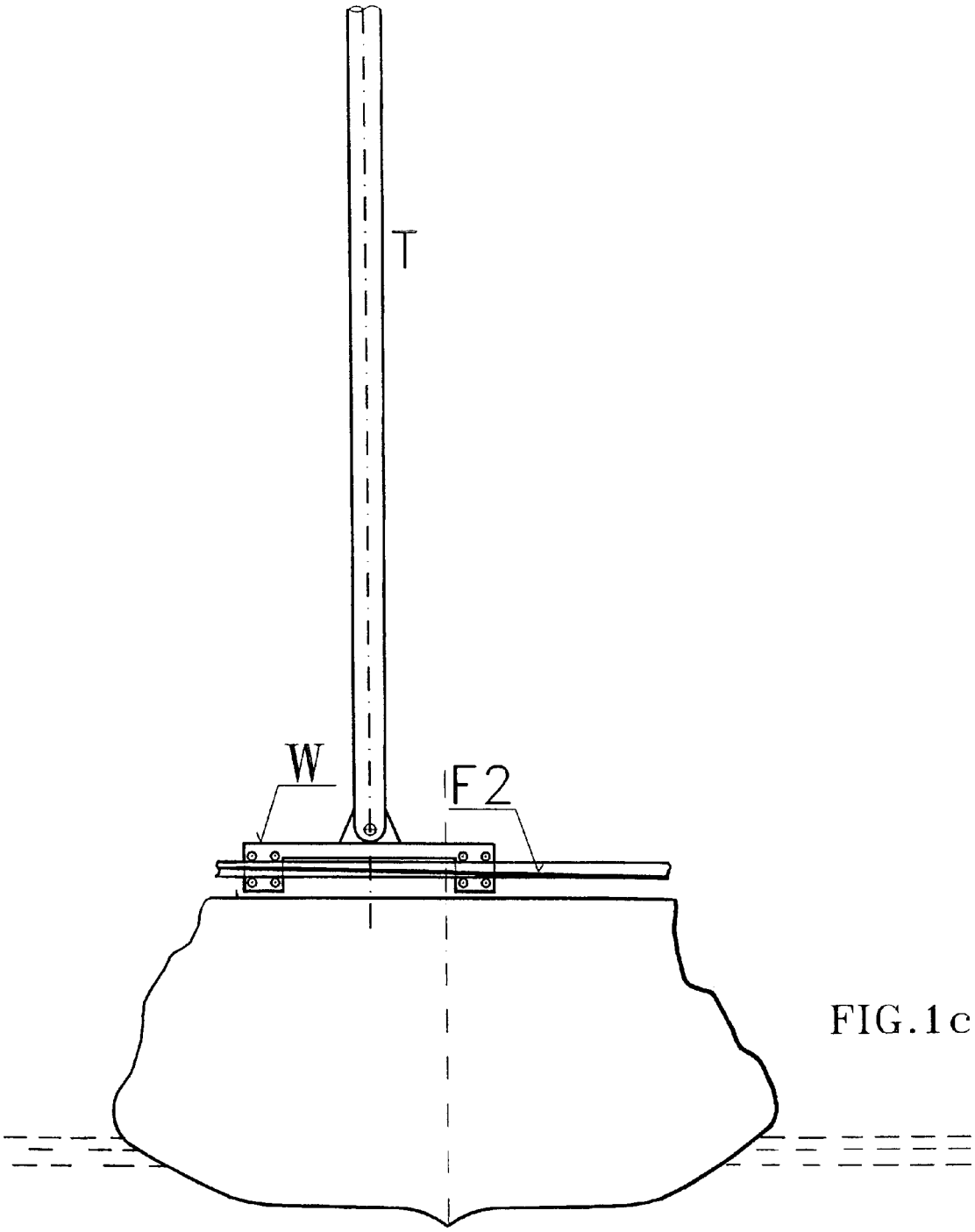
Figures 2, 3, 4:
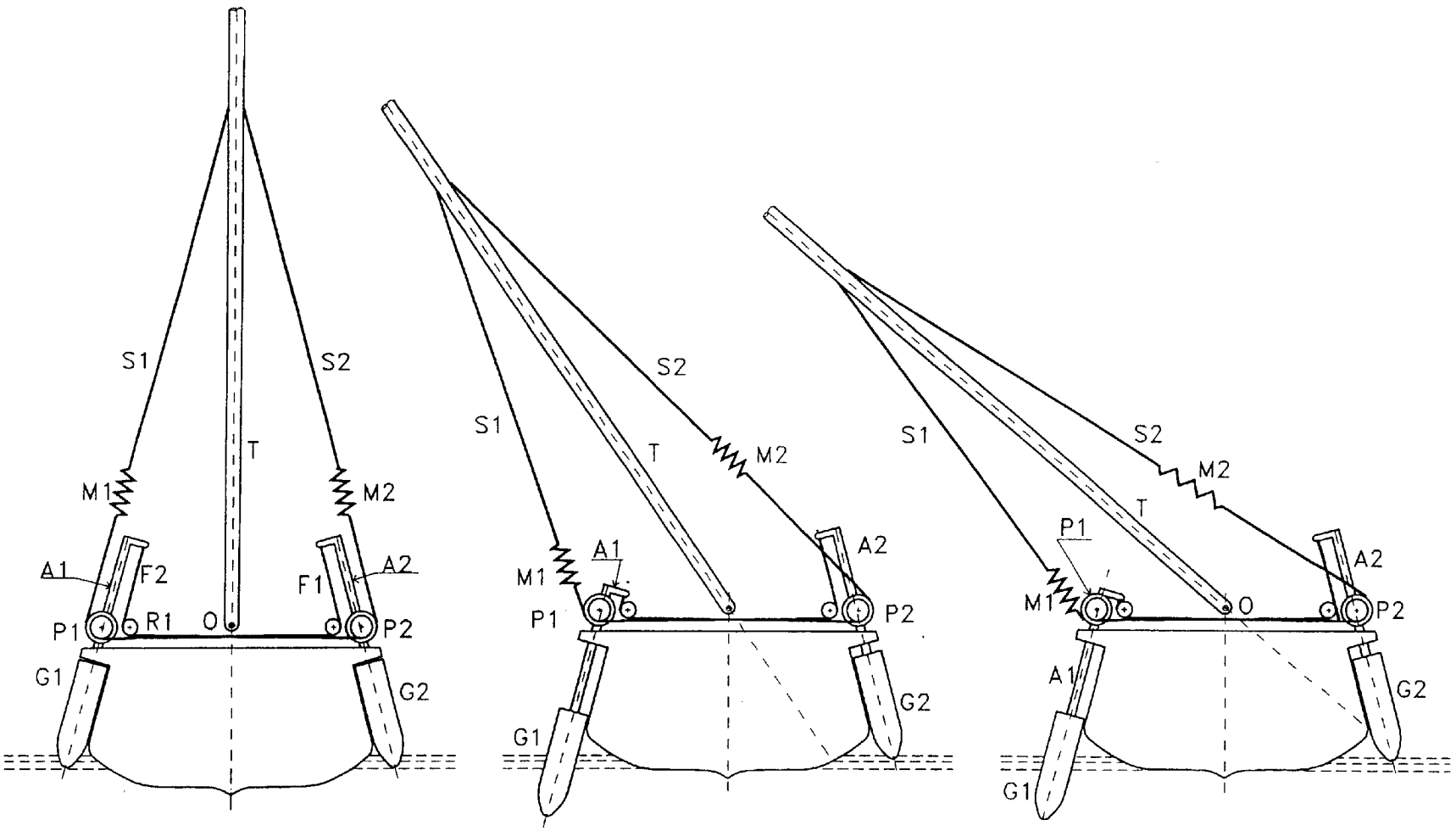
FIG. 2 is the front view of the same boat shown at FIG. 1, at rest, with the invented device applied to both shrouds.
FIG. 3 is the front view of the same boat shown at FIGS. 1 and 2, under normal sailing point, with the invented device applied to both shrouds.
FIG. 4 is the front view of the same boat shown at FIGS. 1, 2 and 3, subjected to strong wind gusts, with the invented device applied to both shrouds.

On FIG. 1, the invented device is drawn, in order to get its understanding easier, only referring to the shroud S2; instead, in FIGS. 2, 3 and 4, the device is drawn referring to both shrouds.

Referring to FIG. 1, the device basically includes:

a mast T that rotates around a longitudinal pin O;

a system transmitting the strength from the shroud S2 to the rod A1, including the winch P2, the rope F2 and the block R1;

a rod A1, placed on the top of float G1, that slides from top to bottom versus the boat hull and integral to the below float G1;

a shaped float G1 placed on the boat side;

a pre-stretched spring M2 placed on the shroud S2.

FIG. 1*a* shows a constructive detail of the spring M2, which is pre-stretched between the pin N1, inserted into the cylinder C1, and the pin N2, inserted into the cylinder C2; when the stretching on the shroud exceeds the pre-stretching of spring M2, the same spring extends, the two cylinders slide one inside the other owing to the shroud extending and the mast tilts following the wind pressure on the sails.

Under normal sailing point, the wind pressure on sails tends to make the mast T to rotate around the pin O, and the shroud S2 is stretched and tends to extend transmitting the strength exerted on it by the mast to the rope F2, interposing the winch P2; on its turn, the rope F2 transmits the strength to the rod A1, sliding from top to bottom on its guide, making the float G1 to sink, whose floating thrust balances the lateral wind pressure on sails. In this manner, the float acts also as a centerboard for the boat, counteracting the wind lateral pressure on sails (FIG. 3).

Under these conditions, the system is designed to achieve mast tilting compatible with good sails efficiency and boat safe sailing point, through a proper dimensioning of the springs M1 and M2, of the reduction ratio of winch P1 and P2, of the shape and volume of floats G1 and G2.

When the wind force exceeds the allowed limits for a safe sailing point with the exposed sails, the pre-stretched spring M2 extends according to the increase of stretching in the shroud S2 on which it is set and makes the shroud to elongate, allowing the mast T to further tilt in respect to the hull, instead avoiding further large sinking of the float G1 (FIG. 4); in such a way we reduce the exposed sails surface in order to avoid excessive or dangerous boat heeling.

The behavior of the described device allows the boat to overcome wind gusts with no hull over-heeling and high safety in respect to the capsizing.

1b—Invention Applied to a Multi-Hull Boat

FIGS. 5, 6, 7 and 8 graphically describe the invention as applied to a multi-hull boat (trimaran).

Figure 5:
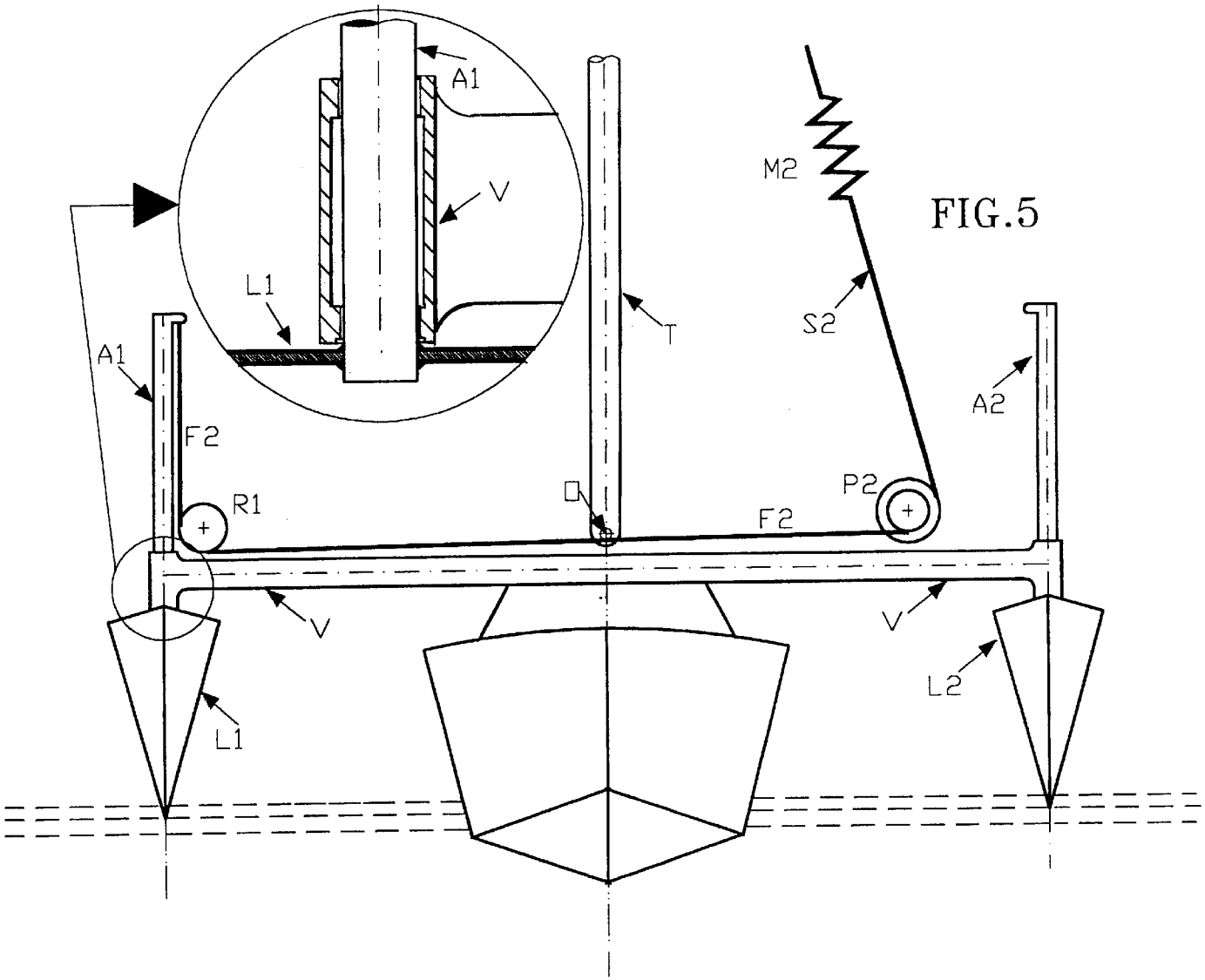
FIGS. 5, 6, 7 and 8 show the invention applied to a trimaran boat, with the same actuation type of FIGS. 1, 2, 3 and 4, and precisely.
Figure 5A:
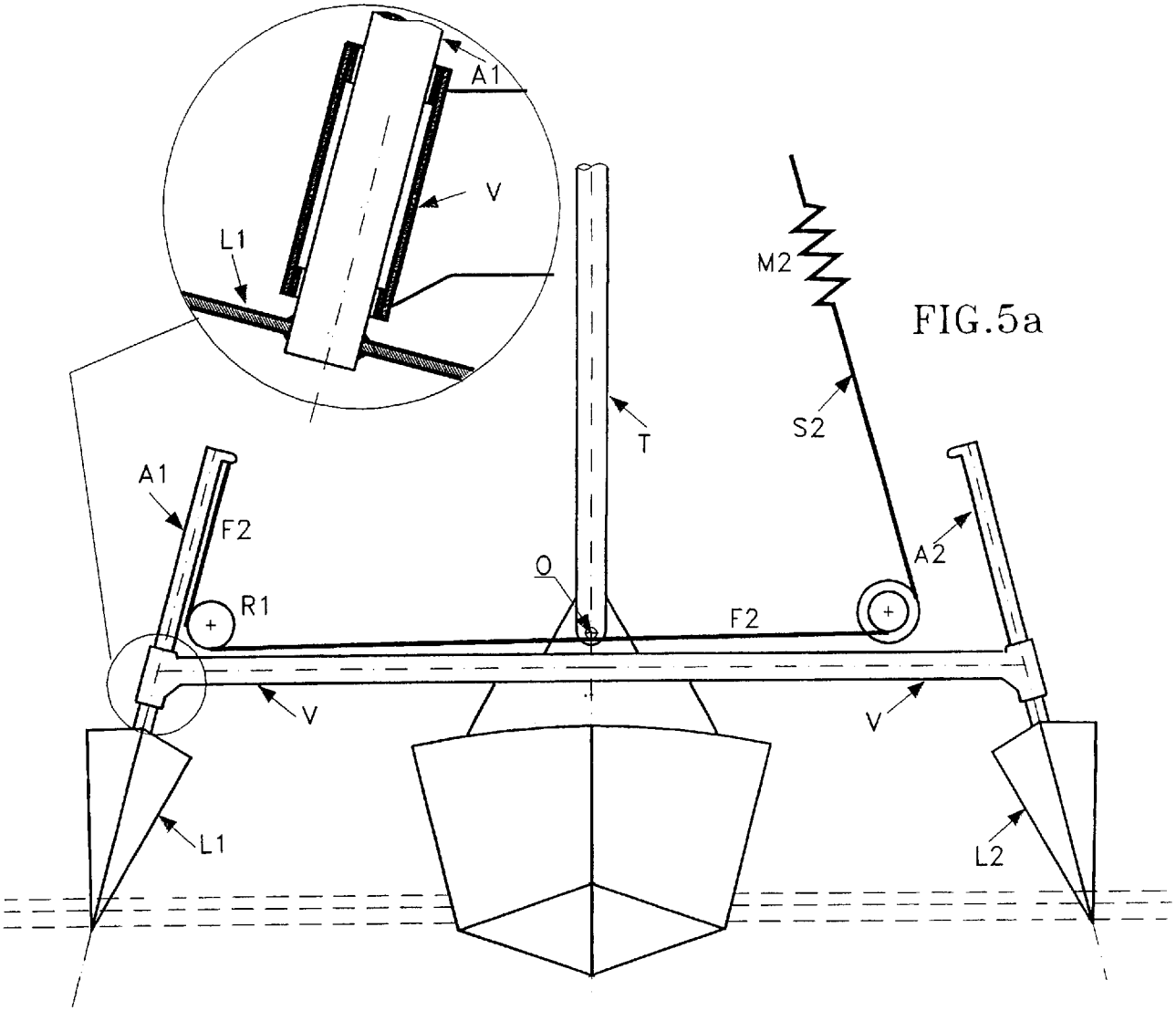

On FIG. 5, the used device is drawn, in order to get its understanding easier, only referring to the shroud S2; the strength transmitted by the mast T to the windward shroud S2 is re-transmitted, through the winch P2, the rope F2 and the block R1 to a rod A1, vertically sliding in respect to the beam V connected to the main hull. This rod A1 is integrally connected to the below lateral hull L1.

Even in this case, a pre-stretched spring M2 is positioned on the shroud S2. The spring is able to limit the strength transmitted by the shroud S2 to the lateral hull L1.

Figures 6, 7, 8:
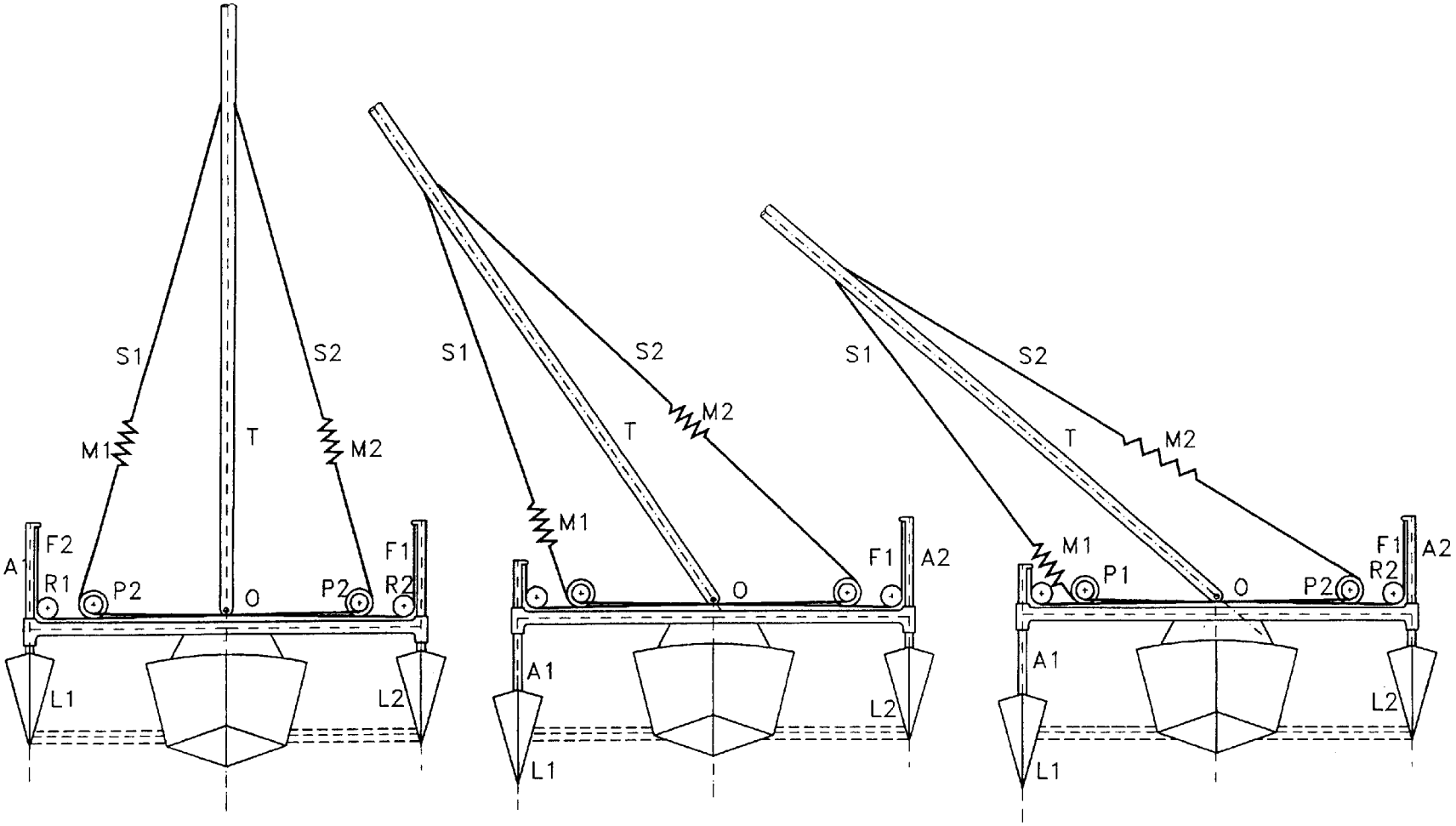

FIGS. 6, 7 and 8 show a boat front view with three different sailing points and the device mounted on both shrouds S1 and S2; basically:

FIG. 6 shows the boat with no heeling moment.

FIG. 7 shows the boat under normal sailing point; the rotation of the mast T around the longitudinal pin O causes a consequent sinking of the lee hull L1, until when the floating thrust of this hull counteracts the strength transmitted by the mast T to the windward shroud S2. The middle hull is submitted to a limited or no heeling due to the compensating action of the floating thrust of the lee hull L1.

When, due to the increase of the wind force, the strength on the windward shroud S2 exceeds the pre-stretching value of the spring M2, the same spring extends, allowing the mast T to make a further rotation, in a partially independent way by the sinking of the lee hull L1 (FIG. 8).

By this way, even in the examined last event, inserting the two springs M1 and M2, we achieve the result of allowing large tilting of the mast T around the pin O. In this manner, the wind effect on sails is reduced, when the wind strength exceeds the limits allowed for a safe sailing, contemporaneously limiting the lee hull sinking to values compatible with a proper sailing point.

2—Second Type of Actuation

Figure 9:
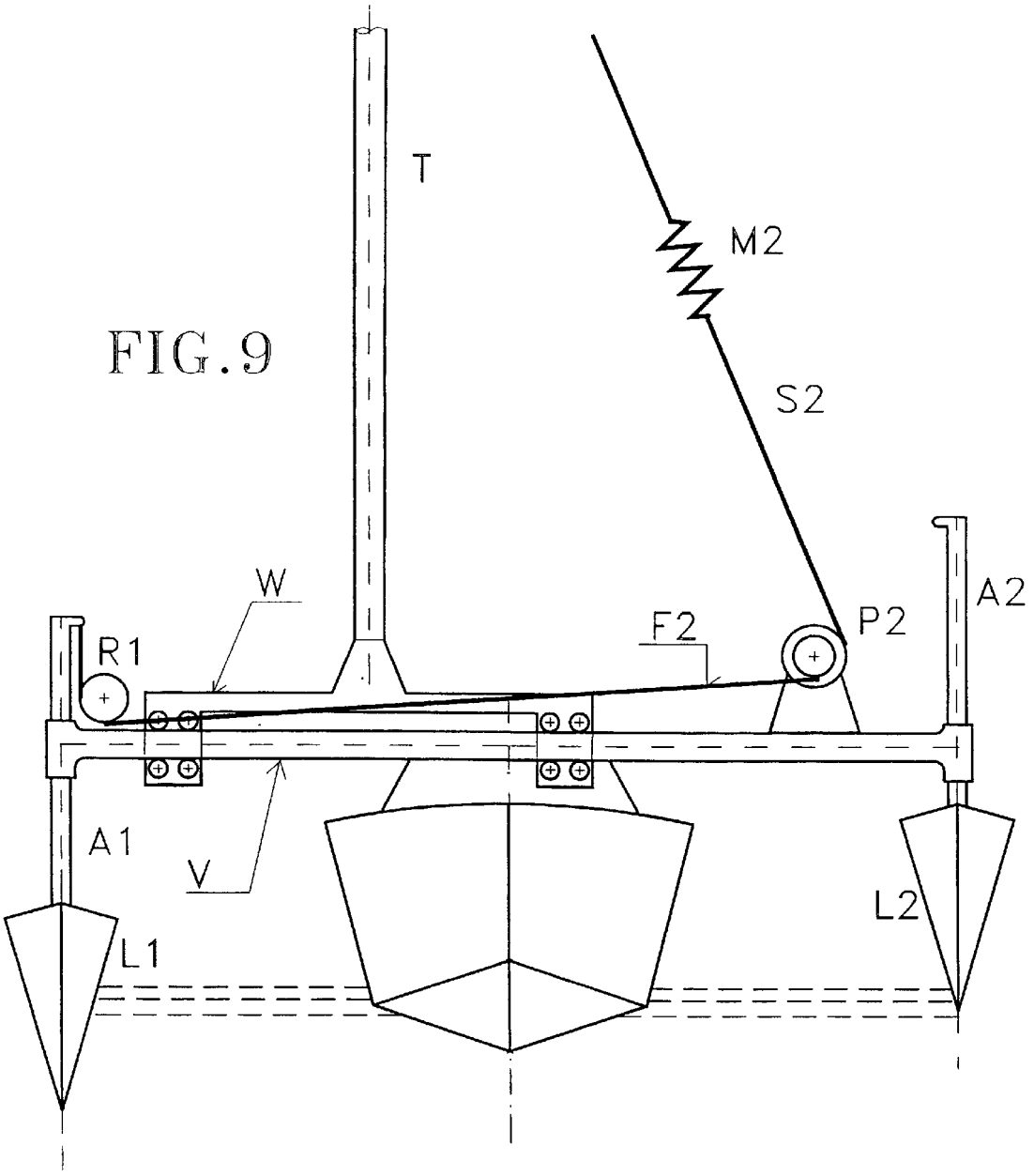
FIGS. 9 and 10 show the invention applied to a trimaran boat, with a different actuation type, consisting in making the mast transversely translate to the hull longitudinal axis, instead of rotating it around the foot, and precisely.
Figure 10:
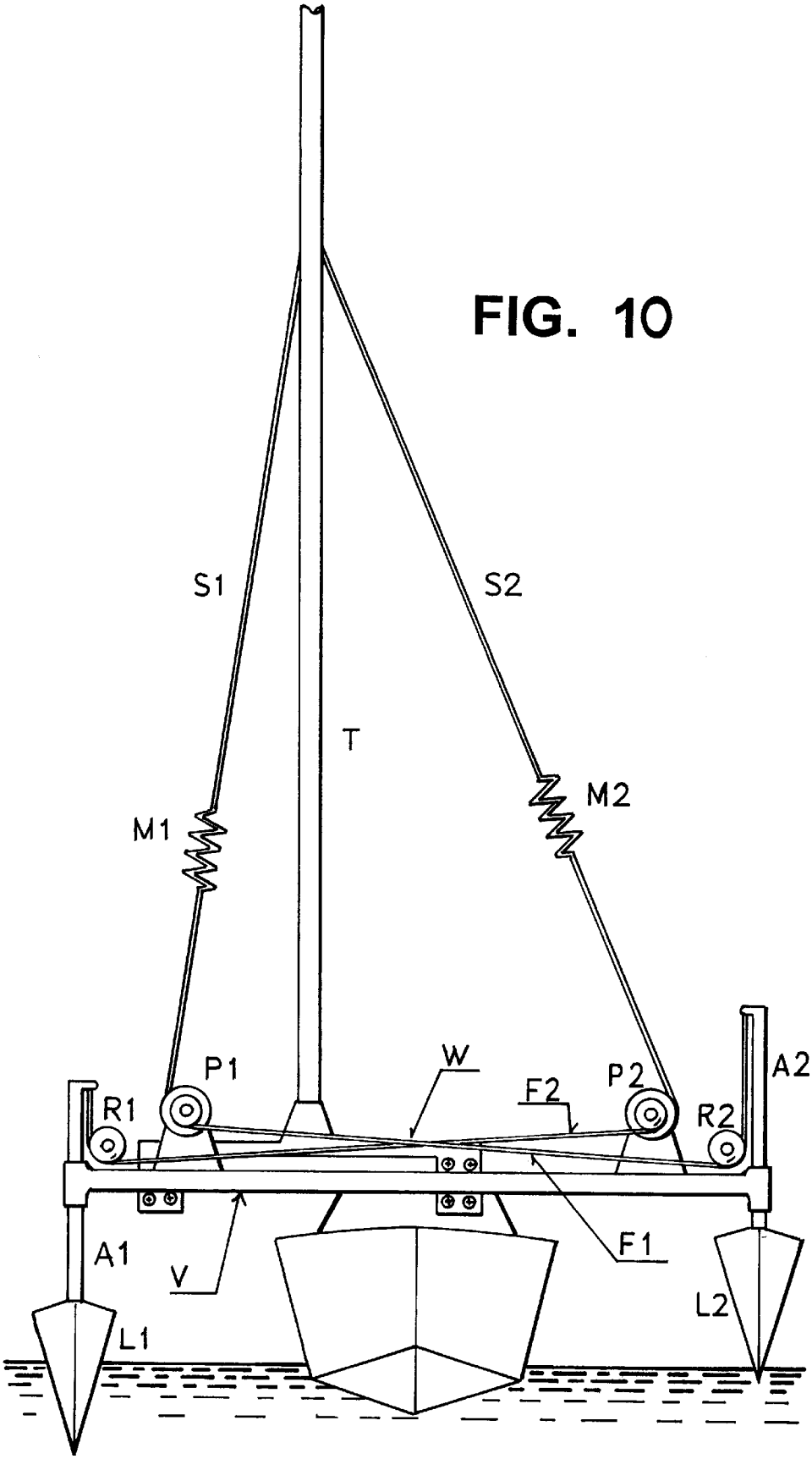

FIGS. 9 and 10 show the second type of actuation of the invention applied to a trimaran boat.

FIG. 9 is the boat front view, under normal sailing point, showing the invented device, in order to get its understanding easier, referring to the shroud S2 only.

The foot of the mast T rests on a guide W, placed on the connection beam between hulls and sliding transversely in respect to the boat, the sail tacks also fastened to this guide. The slide lateral movement involves the stretching of the shroud S2.

On its turn, the shroud is connected to the rod A1, through the winch P2, the rope F2 and the block R1; the rod A1 moves from top to bottom in respect to the connection beam V. The rod A1, integral to the below hull L1, causes the sinking of this latter, until when the floating thrust of the hull L1 counteracts the strength transmitted by the mast T to the windward shroud S2.

FIG. 10 shows the same boat at the same conditions of FIG. 9, but with the device applied to both shrouds.

Since the sail mast can be kept vertical, the better sails efficiency counterbalance the higher constructive problems of this second type of actuation.

Obviously, this second type of actuation can be applied also to a single hull boat.

3—Third Type of Actuation

FIG. 11 is the cross section of a single hull boat under normal sailing point, to which the third type of actuation is applied; on the figure, the device is shown, due to exposition clearness, referring only to the shroud S2.

Referring to FIG. 11, the device includes:

- a system transmitting the force from the shroud S2 to the piston-rod A1 of the hydraulic cylinder Z1, including the winch P2 and the rope F2;
- an hydraulic cylinder Z1, whose body is integral to the boat hull, the rope F2 fixed to the piston-rod A1
- an hydraulic cylinder Z3, whose body is integral to the boat hull, the related piston-rod A3 integral to the float G1;
- a connecting pipeline U1 between cylinders Z1 and Z3;
- a cylindrical guide D1 sliding on the outer surface of the cylinder Z3.

The stretching of the shroud S2, induced by the wind action on sails, is transmitted through the winch P2 and rope F2 to the piston-rod A1 controlling the piston of the hydraulic cylinder Z1; the movement of the piston in the cylinder Z1 is transmitted, through the pipeline U1, to the piston of the hydraulic cylinder Z3 and the movement of the same piston pushes the piston-rod A3, and float G1 connected to it, downward.

Even this third type of actuation can be naturally applied to a multi-hull boat.

Further Types of Actuation

In all three previous types of actuation, the insertion of springs and shock absorbers into the device transmitting the strength, is provided for. This is useful to achieve some selected boat heeling, depending from the mast movements Devices limiting the wind action on sails under anomalous conditions (mechanical springs M1 and M2) can be replaced using other types of pre-stretched hydraulic or pneumatic springs.

Basically, the execution details of the device can be changed without exceeding the invention limits and then the patent limits.

Results in Applying the Invention

The application of the invention produce the following main results:

- higher safety of the boat regarding a possible capsizing;
- higher safety and feasibility of deck operations by the crew, due to the absence of heeling in the walking surfaces;
- better hull comfort, due to the lower or no heeling of walking surfaces and furniture;
- lower risk that stowed charges may move;
- better sails efficiency;
- better boat hydrodynamic behavior, since it can be designed only for a no heeling sailing;
- better boat hydrodynamic behavior, since during stem reach there are no sunk drift surfaces, floats or lateral hulls being all up. During other reaches the lee float or lee hull sinking is proportional to the wind lateral thrust (this corresponds to the centerboard depth adjustment performed by the crew on boats equipped with centerboards);
- implement of the surfing capability of very large boats, due to the pressure reduction exerted by the water on the bottom of the boat when the lee hull or float are sunk.

Whatever is the application type, the device can be calibrated in order to have a boat pre-set behavior while sailing; for instance, one can choose to partially or fully counteract the wind heeling effect on sails or, even, make the hull to tilt windward.

This is achieved by changing strength transmission ratios from the shroud to the float or the lateral hull, the float or hull shape and volume, the tilting of the guide of the rod pushing the float or the lateral hull.

Similarly, the spring device limiting the shroud strength can be calibrated using different parameters, depending if we want to have a higher sails efficiency or a higher hull safety, or otherwise.

According to the various above mentioned arrangements of this device, the invention can be applied on boats of all types, costs and dimensions; in fact, this device could open unexplored ways of sailing.

It should be noted that the boat heeling adjustment is achieved without burdening the hull with ballast. This gives remarkable advantages respect to the speed and to the hull constructive techniques, as well as to hull lightness.

A further remarkable advantage of the invented device is the fully automatically working capability, without any need of crew's interventions; this regards both the actions performed by sinking the lee float or hull, that is the counteracting of both the heeling effect and the boat drift induced by the wind thrust on sails.

I claim:

1. A single-hull sailboat comprising:

at least two shaped and dimensioned floats positioned along side a hull, said hull having at least one foot pivotally connected to at least one sail-mast allowing said sail-mast to rotate laterally in respect to wind direction, and said hull having a leeward-side and a windward-side;

at least one float-rod guide secured to said hull on each said windward and leeward-sides;

at least two rods, said rods secured to said shaped and dimensioned floats and slidably secured to said float-rod guides;

at least one windward shroud secured to said sail-mast at one end and said leeward-side rod at the other end, and said windward shroud being passed through a system of blocks and pulleys for transmitting a force exerted on said sail-mast from said windward shroud to said leeward-side rod;

at least one leeward shroud secured to said sail-mast at one end and said windward-side rod at the other end, and said leeward shroud being passed through a system of blocks and pulleys for transmitting a force exerted on said sail-mast from said leeward shroud to said windward-side rod;

whereby when said sail-mast rotates to said hull's leeward-side, said force exerted on said sail-mast and producing a heeling moment is transmitted to said leeward-side rod pushing said leeward-side float down, causing a sinking depending on the strength of said force, thus a buoyancy caused by sinking of said leeward-side float opposes the heeling moment caused by said force on said sail-mast.

2. The single-hull sailboat of claim 1 wherein said shaped and dimensioned floats are designed in such a way that, when said shaped and dimensioned floats are sunk into water said shaped and dimensioned floats variably oppose boat drift depending on said force.

3. The single-hull sailboat of claim 1, wherein at least one of said shrouds incorporates a pre-loaded spring device allowing said shroud to elongate when said force exceeds a predetermined value, and allowing said sail-mast to turn in such a way as to reduce an exposed sail surface and avoid excessive and dangerous boat heeling.

4. The single-hull sailboat of claim 1 wherein said at least one leeward shroud incorporates a spring device stretching said at least one leeward shroud when said sail-mast rotates to said leeward-side.

5. A multi-hull sailboat comprising:

at least two shaped and dimensioned hulls, said hulls having at least one foot pivotally connected to at least one sail-mast allowing said sail-mast to rotate laterally in respect to wind direction, and said hulls having a leeward-side and a windward-side;

at least two float-rod guides secured to said sail-mast by a beam;

at least two rods, said rods secured to said shaped and dimensioned hulls and slidably secured to said float-rod guides on ends of said beam;

at least one windward shroud secured to said sail-mast at one end and said leeward-side rod at the other end, and said windward shroud being passed through a system of blocks and pulleys for transmitting a force exerted on said sail-mast from said windward shroud to said leeward-side rod;

at least one leeward shroud secured to said sail-mast at one end and said windward-side rod at the other end, and said leeward shroud being passed through a system of blocks and pulleys for transmitting a force exerted on said sail-mast from said leeward shroud to said windward-side rod;

whereby when said sail-mast rotates to said hull's leeward-side, said force exerted on said sail-mast and producing a heeling moment is transmitted to said leeward-side rod pushing said leeward-side hull down, causing a sinking depending on the strength of said force, thus a buoyancy caused by sinking of said leeward-side hull opposes the heeling moment caused by said force on said sail-mast.

6. The multi-hull sailboat of claim 5 wherein said shaped and dimensioned hulls are designed in such a way that, when said shaped and dimensioned hulls are sunk into water said shaped and dimensioned hulls variably oppose boat drift depending on said force.

7. The multi-hull sailboat of claim 5, wherein at least one of said shrouds incorporates a pre-loaded spring device allowing said shroud to elongate when said force exceeds a predetermined value, and allowing said sail-mast to turn in such a way as to reduce an exposed sail surface and avoid excessive and dangerous boat heeling.

8. The multi-hull sailboat of claim 5 wherein said at least one leeward shroud incorporates a spring device stretching said at least one leeward shroud when said sail-mast rotates to said leeward-side.

9. A single-hull sailboat comprising:

at least two shaped and dimensioned floats positioned along side a hull, said hull having at least one foot fixedly secured to at least one sail-mast allowing said sail-mast to slide on a guide transversely in respect to the hull and in-line with a wind direction, a plurality of sail tacks also fastened to said guide, and said hull having a leeward-side and a windward-side;

at least one float-rod guide secured to said hull on each said windward and leeward-sides;

at least two rods, said rods secured to said shaped and dimensioned floats and slidably secured to said float-rod guides;

at least one windward shroud secured to said sail-mast at one end and said leeward-side rod at the other end, and said windward shroud being passed through a system of blocks and pulleys for transmitting a force exerted on said sail-mast from said windward shroud to said leeward-side rod;

at least one leeward shroud secured to said sail-mast at one end and said windward-side rod at the other end, and said leeward shroud being passed through a system of blocks and pulleys for transmitting a force exerted on said sail-mast from said leeward shroud to said windward-side rod;

whereby when said sail-mast slides transversely in respect to said hull and in-line with said wind direction to said hull's leeward-side, said force exerted on said sail-mast and producing a heeling moment is transmitted to said leeward-side rod pushing said leeward-side float down, causing a sinking depending on the strength of said force, thus a buoyancy caused by sinking of said leeward-side float opposes the heeling moment caused by said force on said sail-mast.

10. The single-hull sailboat of claim 9 wherein said shaped and dimensioned floats are designed in such a way that, when said shaped and dimensioned floats are sunk into water said shaped and dimensioned floats variably oppose boat drift depending on said force.

11. The single-hull sailboat of claim 9, wherein at least one of said shrouds incorporates a pre-loaded spring device allowing said shroud to elongate when said force exceeds a predetermined value, and allowing said sail-mast to turn in such a way as to reduce an exposed sail surface and avoid excessive and dangerous boat heeling.

12. The single-hull sailboat of claim 9 wherein said at least one leeward shroud incorporates a spring device stretching said at least one leeward shroud when said sail-mast rotates to said leeward-side.

13. A multi-hull sailboat comprising:

at least two shaped and dimensioned hulls, said hulls having at least one foot fixedly secured to at least one sail-mast allowing said sail-mast to slide on a guide on a beam transversely in respect to the hulls and in-line with a wind direction, and said hulls having a leeward-side and a windward-side;

at least two float-rod guides secured to said sail-mast by a beam;

at least two rods, said rods secured to said shaped and dimensioned hulls and slidably secured to said float-rod guides on ends of said beam;

at least one windward shroud secured to said sail-mast at one end and said leeward-side rod at the other end, and said windward shroud being passed through a system of blocks and pulleys for transmitting a force exerted on said sail-mast from said windward shroud to said leeward-side rod;

at least one leeward shroud secured to said sail-mast at one end and said windward-side rod at the other end, and said leeward shroud being passed through a system of blocks and pulleys for transmitting a force exerted on said sail-mast from said leeward shroud to said windward-side rod;

whereby when said sail-mast slides transversely in respect to said hulls and in-line with said wind direction to said hull's leeward-side, said force exerted on said sail-mast and producing a heeling moment is transmitted to said leeward-side rod pushing said leeward-side hull down, causing a sinking depending on the strength of said force, thus a buoyancy caused by sinking of said leeward-side hull opposes the heeling moment caused by said force on said sail-mast.

14. The multi-hull sailboat of claim 13 wherein said shaped and dimensioned hulls are designed in such a way that, when said shaped and dimensioned hulls are sunk into water said shaped and dimensioned hulls variably oppose boat drift depending on said force.

15. The multi-hull sailboat of claim 13, wherein at least one of said shrouds incorporates a pre-loaded spring device allowing said shroud to elongate when said force exceeds a predetermined value, and allowing said sail-mast to turn in such a way as to reduce an exposed sail surface and avoid excessive and dangerous boat heeling.

16. The multi-hull sailboat of claim 13 wherein said at least one leeward shroud incorporates a spring device stretching said at least one leeward shroud when said sail-mast rotates to said leeward-side.

* * * * *

UNITED STATES PATENT AND TRADEMARK OFFICE

CERTIFICATE OF CORRECTION

PATENT NO. : 5,947,045

DATED : September 7, 1999

INVENTOR(S) : Pietro IMMORDINO

It is certified that errors appear in the above-identified patent and that said Letters Patent is hereby corrected as shown below:

Title page, [76] Inventor, change "IMMORDINO PIETRO" to – PIETRO IMMORDINO–.

item [19], delete "Pietro" and insert --Immordino--.

Signed and Sealed this

Ninth Day of May, 2000

*Attest:*

Q. TODD DICKINSON

*Attesting Officer*

*Director of Patents and Trademarks*